United States Patent [19]

Arimi

[11] Patent Number: 5,019,182

[45] Date of Patent: May 28, 1991

[54] METHOD OF FORMING HARD STEELS BY CASE HARDENING, SHOT-PEENING AND AGING WITHOUT TEMPERING

[75] Inventor: Yukio Arimi, Hiroshima, Japan

[73] Assignee: Mazda Motor Corporation, Hiroshima, Japan

[21] Appl. No.: 412,774

[22] Filed: Sep. 26, 1989

[30] Foreign Application Priority Data

Sep. 27, 1988 [JP] Japan ..... 63-241658

[51] Int. Cl.[5] ..... C21D 8/00

[52] U.S. Cl. ..... 148/12.1; 148/16.5; 148/16.6

[58] Field of Search ..... 148/12.1, 16.5, 16.6

[56] References Cited

U.S. PATENT DOCUMENTS 4,415,378 11/1983 McKinney ..... 148/16.5

FOREIGN PATENT DOCUMENTS 60-218423 11/1985 Japan .
62-196322 8/1987 Japan .
62-207822 9/1987 Japan .
64-31927 2/1989 Japan .

*Primary Examiner*—Melvyn J. Andrews
*Assistant Examiner*—Margery S. Phipps
*Attorney, Agent, or Firm*—Wenderoth, Lind & Ponack

[57] ABSTRACT

A method of manufacturing a steel member comprising the steps of: carburizing and quenching or carbo-nitriding and quenching a steel material; shot-peening the steel material quenched in the first step without tempering; and aging the steel material shot-peened in the second step. Preferably the steel material comprises 0.1 to 0.4 wt. % C, 0.06 to 0.15 wt. % Si, 0.3 to 1.0 wt. % Mn, 0.9 to 1.2 wt. % Cr, 0.3 to 0.5 wt. % Mo, and the remainder Fe. The steel member is preferably used in transmission gears for automobiles, which require superior strength.

6 Claims, 5 Drawing Sheets

METHOD OF FORMING HARD STEELS BY CASE HARDENING, SHOT-PEENING AND AGING WITHOUT TEMPERING

BACKGROUND OF THE INVENTION

This invention relates to a method of manufacturing steel members such as transmission gears of automobiles which require superior strength property.

Recently, with the rise of powerful, light and simplified engines, it has been urged to manufacture steel members used for transmission gears of automobiles which can meet the demand of higher bending fatigue strength and higher pitting strength as well as superior strength.

The following methods have been known as the conventional manufacturing processes of steel members requiring superior strength. The first method comprises the steps of carburizing and quenching or carbo-nitriding and quenching a steel material, and shot-peening said steel material. The second method, as disclosed in Japanese Patent Application Laying Open Gazette No. 60-218423, comprises the steps of tempering a steel material after heat treatment, shot-peening said steel material, and re-tempering said steel member at a temperature lower than that in the tempering step. The third method, as disclosed in Japanese Patent Application Laying Open Gazette No. 62-207822, comprises the steps of tempering a steel member after carburizing and quenching, shot-peening said steel member, and aging said steel member.

The first method mentioned above is to improve fatigue strength of a steel material by shot-peening, that is injecting shots on the surface of a steel material to strengthen the surface layer thereof with a surface-hardening treatment, and to create compressive residual stress in the surface of the steel material. However, in this method, sufficient pitting strength required for steel members used in transmission gears cannot be achieved.

The second method is to improve fatigue strength by retempering a steel material to precipitate $\epsilon$-carbide therein. However, since a steel material is tempered before shot-peening, this method results in a decreased amount of retained austenite in the steel material. Consequently, shot-peening after tempering does not lead to obtaining enough compressive residual stress in the steel material, thus failing to achieve improvement of fatigue strength. In this method, sufficient pitting strength required for steel members used in transmission gears cannot be obtained, as in the first method.

In the third method, since a steel material is tempered before shot-peening as in the second method, this third method results in a decreased amount of retained austenite in the steel material. Therefore, sufficient improvement in fatigue strength of the steel member cannot be achieved. As for pitting strength, the same is applied to the third method as in the second method.

The object of the present invention is to provide a method of manufacturing a steel member which can improve pitting strength as well as fatigue strength thereof.

SUMMARY OF THE INVENTION

To improve pitting strength as well as fatigue strength of a steel member, the present invention relates to a method of manufacturing a steel member which comprises three steps of: carburizing and quenching or carbo-nitriding and quenching a steel material; shot-peening the steel material quench-hardened in the first step without tempering; and aging the steel material shot-peened in the second step.

DETAILED DESCRIPTION OF THE INVENTION

Figure 1:
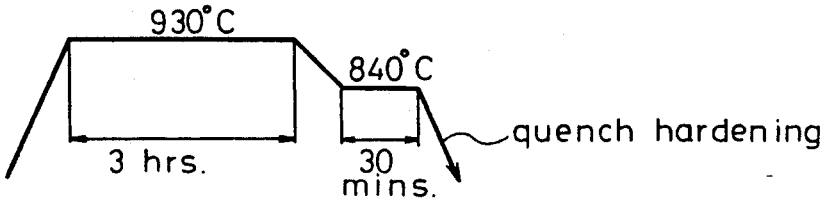
FIG. 1 illustrates a heat treatment pattern of example 1 of the method of manufacturing the steel member in the present invention.

The following is a description of a preferred embodiment of this invention.

As a steel material, an alloy steel prepared in this invention comprises 0.1 to 0.4 wt % C, 0.06 to 0.15 wt % Si, 0.3 to 1.0 wt % Mn, 0.9 to 1.2 wt % Cr, 0.3 to 0.5 wt % Mo, and the remainder Fe.

The reason for setting the composition of the alloy steel as described above is as follows.

C is an essential element which can contribute to increasing strength of a steel material. Therefore, not less than 0.1 wt % content of C is necessary to strengthen the core of a steel material by carburizing and quenching. However, over 0.4 wt % content of C results in brittleness due to decreased toughness and in decreased machinability of a steel member. Accordingly, the content of C should preferably be within the range of 0.1 to 0.4 wt %.

Si is a element which can facilitate oxidation of the grain boundary, inducing the formation of abnormal surface layer in a steel member. Therefore, over 0.15 wt % content of Si has a negative effect on the steel member. Since this element is irrelevant to hardenability of the steel member, the content of Si should preferably be as low as possible. However, Si is used as a deoxidiser or for lowering the fusing point to save the fusion energy. This means that not less than 0.06 wt % of Si is required when manufacturing steel members. As a result, the content of Si should preferably be within the range of 0.06 to 0.15 wt %.

Mn is an element which can facilitate oxidation of the grain boundary, inducing the formation of abnormal surface layer in the steel member. Therefore, the content of Mn should be as low as possible. However, if it contains not more than 0.15 wt % of Si and not less than 0.3 wt % of Mo, a steel member is not subject to a negative effect when containing not more than 1 wt % Mn. When containing less than 0.3 wt % Mn, hardenability of a steel member in the core portion thereof becomes insufficient. This means that the content of Mn should preferably be within the range of 0.3 to 1 wt %.

Cr is an element which can facilitate oxidation of the grain boundary, inducing the formation of abnormal surface layer in the steel member. Therefore, the content of Cr should be as low as possible. However, if it contains not more than 0.15 wt % of Si and not less than 0.3 wt % of Mo, a steel member is not subject to a negative effect when containing not more than 1.2 wt % of Cr. When containing less than 0.9 wt % of Cr, a the core portion of a steel member is insufficiently treated by quench hardening. This means that the content of Cr should preferably be within the range of 0.9 to 1.2 wt %.

Mo is an element which can prevent the grain boundary from oxidizing and can improve hardenability, and thus reducing abnormal surface layer. However, the effect of this property is leveled off when the content of Mo exceeds 0.5 wt % whereas maximum effect cannot be obtained when the content of Mo is less than 0.3 wt %, resulting in insufficient hardenability in the core portion of a steel member. Therefore, the content of Mo should preferably be within the range of 0.3 to 0.5 wt %. In addition to the above-mentioned property of reducing abnormal surface layer within the above-described range of its content, Mo can strengthen the metallic structure itself.

In the method of manufacturing the steel member in the present invention, first step is to carburize and quench the steel material having a composition mentioned above. Conventional methods and conditions of carburizing and quenching can be adopted. However, hardening depth or depth of the layer below the surface to the portion of Hv550 should be within the range of 0.2 to 1.3 mm. The reason for setting this condition is that pitting strength of a steel member being obtained is insufficient when hardening depth is less than 0.2 mm whereas depth of abnormal surface layer becomes thick and has a negative effect upon fatigue and pitting strength of a steel member being obtained when hardening depth exceeds 1.3 mm.

In the next step, carburized and quenched steel material is to be shot-peened under the condition of shot-hardness: $H_RC50$ to 65 (Rockwell hardness) and/or shot-speed: 60 to 150 m/sec. That is because, under the condition of a shot-hardness less than $H_RC50$ and shot-speed less than 60 m/sec, the steel material being shot-peened is insufficiently treated, which will lead to the result that sufficient effect of aging treatment in the next step cannot be obtained, and on the other hand, under the condition of shot-hardness over $H_RC65$ and shot-speed over 120 m/sec, further treatment of the steel material cannot be expected, and shot damage increases. Retained austenite generated in the carburizing and quenching step transforms into martensite in this shot-peening step to be hardened and creates compressive residual stress. In this way, shot-peening the steel material without tempering after quench hardening results in prevention of reduction in the amount of retained austenite caused by tempering. Consequently, since high compressive residual stress is obtained after shot-peening treatment, propagation of fatigue cracks and pitting cracks can be restrained. Furthermore, it leads to reduction in cost if tempering treatment is dispensed with.

In the third step, shot-peened steel material is aged at 100° C. to 200° C. for not less than 10 minutes. The reason for setting the above-mentioned temperature condition is that a temperature of less than 100° C. is not enough for achieving maximum effect of aging treatment, whereas a temperature of over 200° C. leads to loss of compressive residual stress generated by shot peening treatment, thereby resulting in decreased fatigue strength of the steel member.

Although due to severe treatment in the step of shot-peening, microholes were formed in the surface layer of the steel material because of dislocation of iron atoms, with the aging treatment in this step, enterable atoms such as carbon and nitrogen enter into and are held inside the microholes due to thermal diffusion at low temperature. As a result, the surface layer of the steel material is hardened, thus preventing occurrence of pitting cracks in the steel member obtained.

Carburizing and quenching adopted in the preferred embodiment mentioned above can be substituted for carbonitriding and quenching. Compared with an example using the method of carburizing and quenching, when adopting the method of carbo-nitriding and quenching, aging effect by nitrogen added in this method increases and as a result pitting strength of the steel member being obtained is further improved.

After the steps of carburizing and quenching and shot-peening adopted in the preferred embodiment above, surface coating treatments such as phosphate coating treatment, molybdenum disulfide coating treatment, and sulphurizing coating treatment can be applied to form a lubricating coating on the surface of the steel material. Since surface coating treatment applied after the first and the second steps accompanies aging treatment as well, pitting strength can be improved as in the further example mentioned above. Furthermore, conformability of the coating layer itself, or conformability of contact surfaces can alleviate plane pressure of steel members, thus further improving pitting strength of the steel member.

Examples and comparative examples of the manufacturing method of the steel member in this invention will be discussed as follows.

An alloy steel of JIS-SCM420H is prepared as a steel material.

EXAMPLE 1

As shown in the heat treatment pattern of FIG. 1, above-mentioned steel material was held for 3 hours at 930° C. Then after being held for 30 minutes at 840° C., the steel material was carburized and quenched. Next, the steel material was shot-peened under the condition of shot-hardness: $H_RC55$ to 58, shot-speed: 90 to 100 m/sec. And after being held for one and a half hours at 160° C., the steel material was aged by air-cooling.

EXAMPLE 2

Figure 2A:
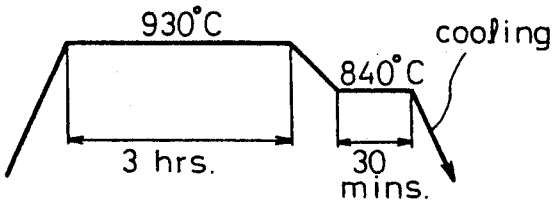
FIG. 2*a* and FIG. 2*b* illustrate a heat treatment pattern of example 2 of the method of manufacturing the steel member.
Figure 2B:
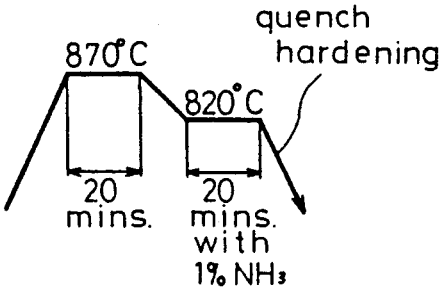

As shown in heat treatment pattern of FIG. 2*a* and FIG. 2*b*, after being held for 3 hours at 930° C., the steel material was carburized and quenched by being held for 30 minutes at 840° C. and then was cooled. Next, after being held for 20 minutes at a temperature of 870° C., the steel material was held in the mixture gas atmosphere with 1% $NH_3$ gas for 20 minutes at 820° C. and then carburized and quenched. After this step, the steel material was shot-peened as in example 1. Finally, after being held for one and a half hours at 190° C., the steel material was aged by air-cooling.

EXAMPLE 3

After being carburized and quenched, and shot-peened as in example 1, the steel material was coated with manganese phosphate by being dipped for one hour in manganese phosphate solution of approximately 100° C. With this coating treatment, a coating of 5 to 10 μm in thickness was formed on the surface thereof.

EXAMPLE 4

After being carburized and quenched, and shot-peened as in example 1, the steel material was applied with molybdenum disulfide thereon at temperatures between 180° to 190° C. With this molybdenum disulfide coating treatment, a coating of 10 to 20 μm in thickness was formed on the surface thereof.

EXAMPLE 5

After being carburized and quenched, and shot-peened as in example 1, the steel material was dipped in molten salt solution containing sulfur at 190° C. for 30 minutes for sulphurizing coating treatment. With this coating treatment, a coating of 5 to 10 μm was formed on the surface thereof.

EXAMPLE 6

After being carburized and quenched, and shot-peened as in example 1, the steel material was coated with manganese phosphate as in example 3. Then, the steel material was coated with molybdenum disulfide as in example 4.

EXAMPLE 7

After being carburized and quenched as in example 2, the steel material was coated with manganese phosphate as in example 3.

EXAMPLE 8

After being carburized and quenched, and carbo-nitrided and quenched as in example 2, the steel material was coated with manganese phosphate as in example 3. Further, the steel material was coated with molybdenum disulfide as in example 4.

COMPARATIVE EXAMPLE 1

Figure 3A:
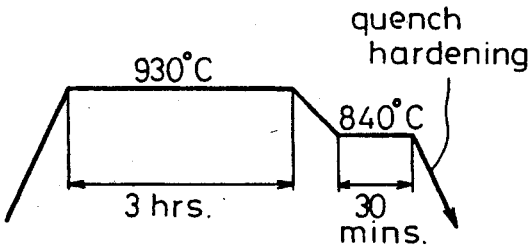
FIG. 3*a* and FIG. 3*b* illustrate a heat treatment pattern of comparative example 1 of the method of manufacturing the steel member.
Figure 3B:
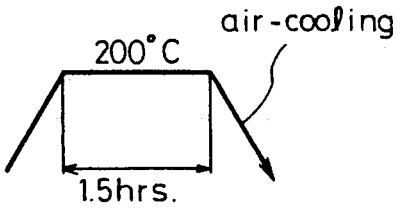

As shown in heat treatment patterns of FIG. 3*a* and FIG. 3*b*, after being held for 3 hours at 930° C., the steel material was held for 30 minutes at 840° C. and then was carburized and quenched by cooling rapidly. Next, after being held for one and a half hours at 200° C., the steel material was tempered by air-cooling. Although being shot-peened as in example 1 after tempering, the steel material was not treated by aging.

COMPARATIVE EXAMPLE 2

The steel material was carburized and quenched, tempered, and shot-peened as in comparative example 1. Then, after being held for one and a half hours at 160° C., the steel material was aged by air-cooling.

To evaluate the manufacturing method of this invention, test results of examples and comparative examples will be described as follows.

Figure 4:
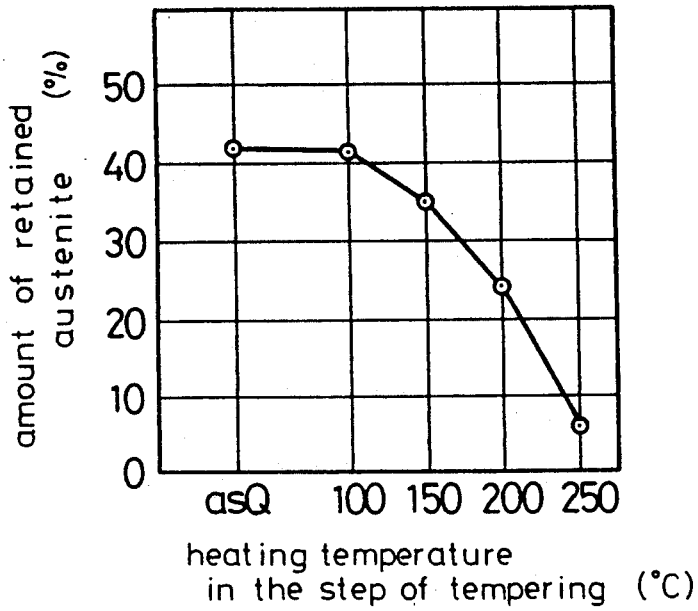
FIG. 4 shows a relationship between heating temperature in the step of tempering after quench hardening and the amount of retained austenite.

FIG. 4 illustrates a relationship between a heating temperature in the step of tempering when tempering the steel material after quench hardening and the amount of retained austenite. This shows that the amount of retained austenite of which 42% was generated in the step of carburizing and quenching decreased in the subsequent step of tempering. FIG. 4 clearly shows that although there is almost no decrease in the amount of retained austenite when the heating temperature of the tempering step is not more than 100° C., the amount of retained austenite much decreases when the heating temperature of the tempering step is within the normal range of 150° to 200° C. The amount of retained austenite decreases to about 24% when heated at 200° C. in the tempering step as in comparative examples 1 and 2.

Figure 5:
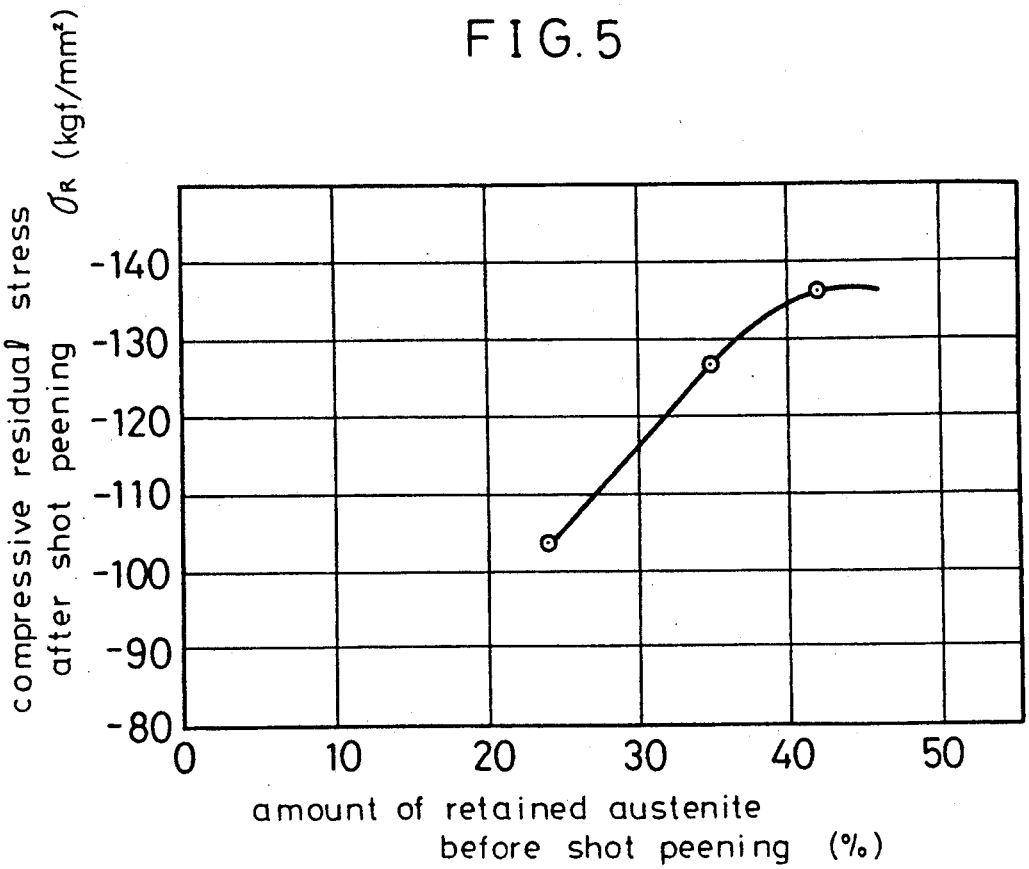
FIG. 5 shows a relationship between the amount of retained austenite before shot-peening and peak value of compressive residual stress after shot-peening.

FIG. 5 shows a relationship between the amount of retained austenite before shot-peening and peak value of compressive residual stress after shot-peening. In this case, shot-peening was conducted under relatively high peening strength condition as in the examples and comparative examples. Peak value of compressive residual stress when conducting no tempering as in examples is about 137 kgf/mm$^2$, while peak value of compressive residual stress when conducting tempering decreased to about 104 kgf/mm$^2$.

Figure 6:
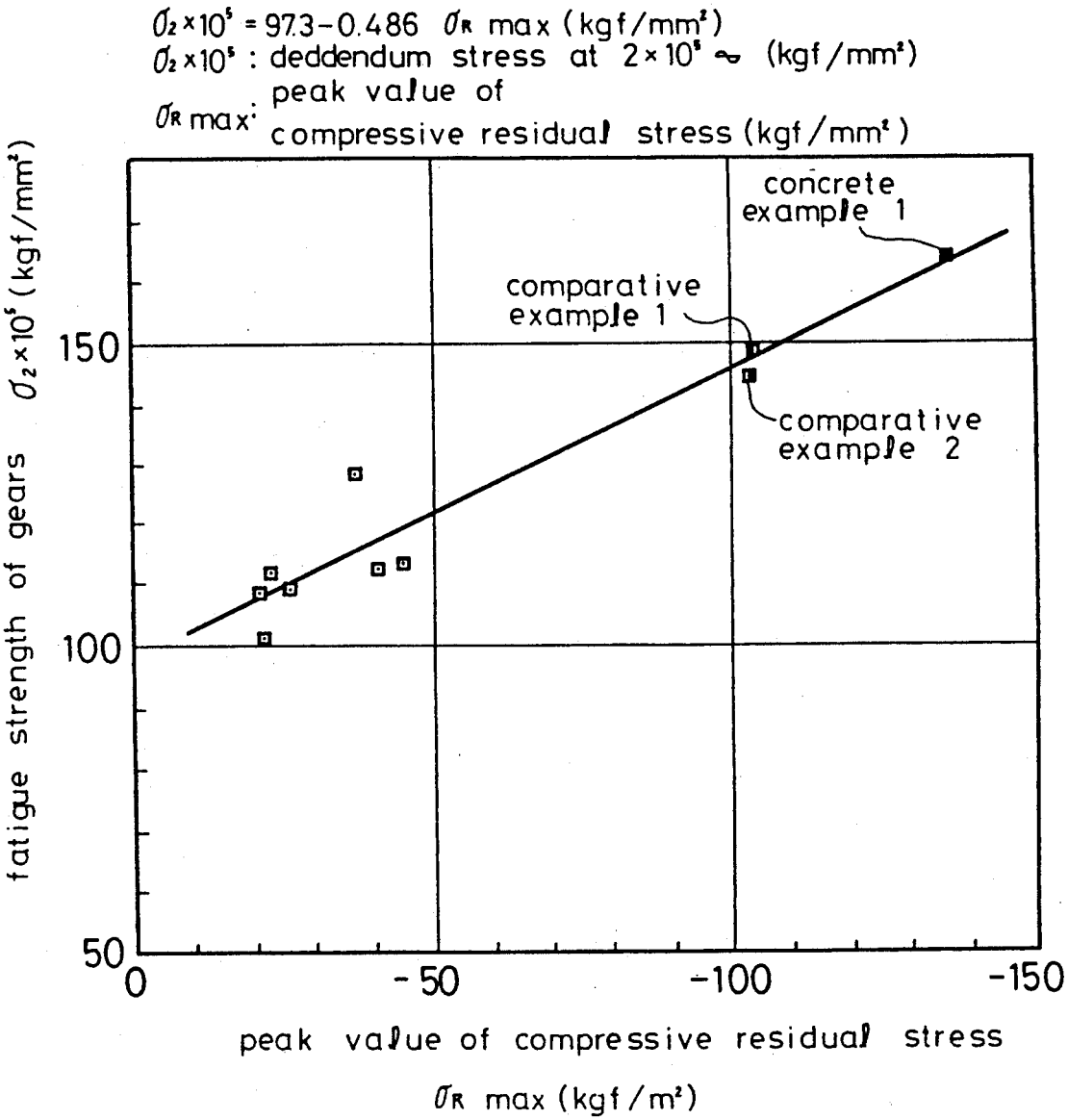
FIG. 6 shows a relationship between peak value of compressive residual stress and fatigue strength of gears.

FIG. 6 shows a relationship between peak value of compressive residual stress and fatigue strength of gears manufactured by the methods of example 1 and comparative examples 1 and 2. Fatigue test condition for gears adopted here is as follows. Testing machine is of power circulation type with revolution speed of 3000 r.p.m. Lubricating oil is of 80W90 type with oil temperature of 70°±3° C. supplied by both injection and dropping. Gears obtained in comparative examples 1 and 2 decrease about 10% in fatigue strength compared with gears obtained in example 1. Therefore, it is obvious that the difference in peak value of compressive residual stress caused, depending on whether tempering was conducted or not after quenching, is shown as a difference in fatigue strength of gears as finished products.

Figure 7:
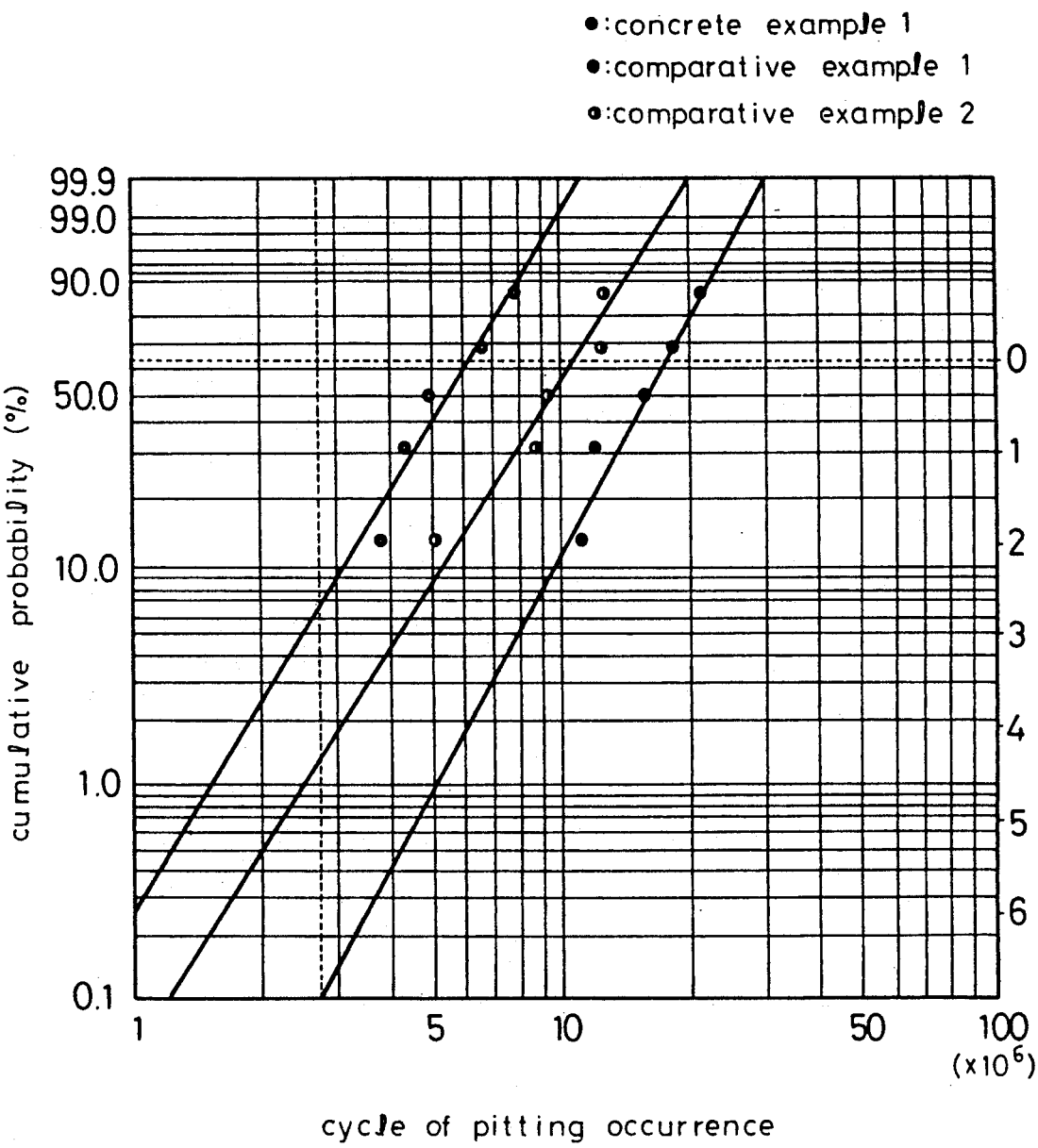
FIG. 7 shows results of pitting tests conducted for steel members obtained in example 1, and comparative examples 1 and 2 of the method of manufacturing the steel member.
Figure 8:
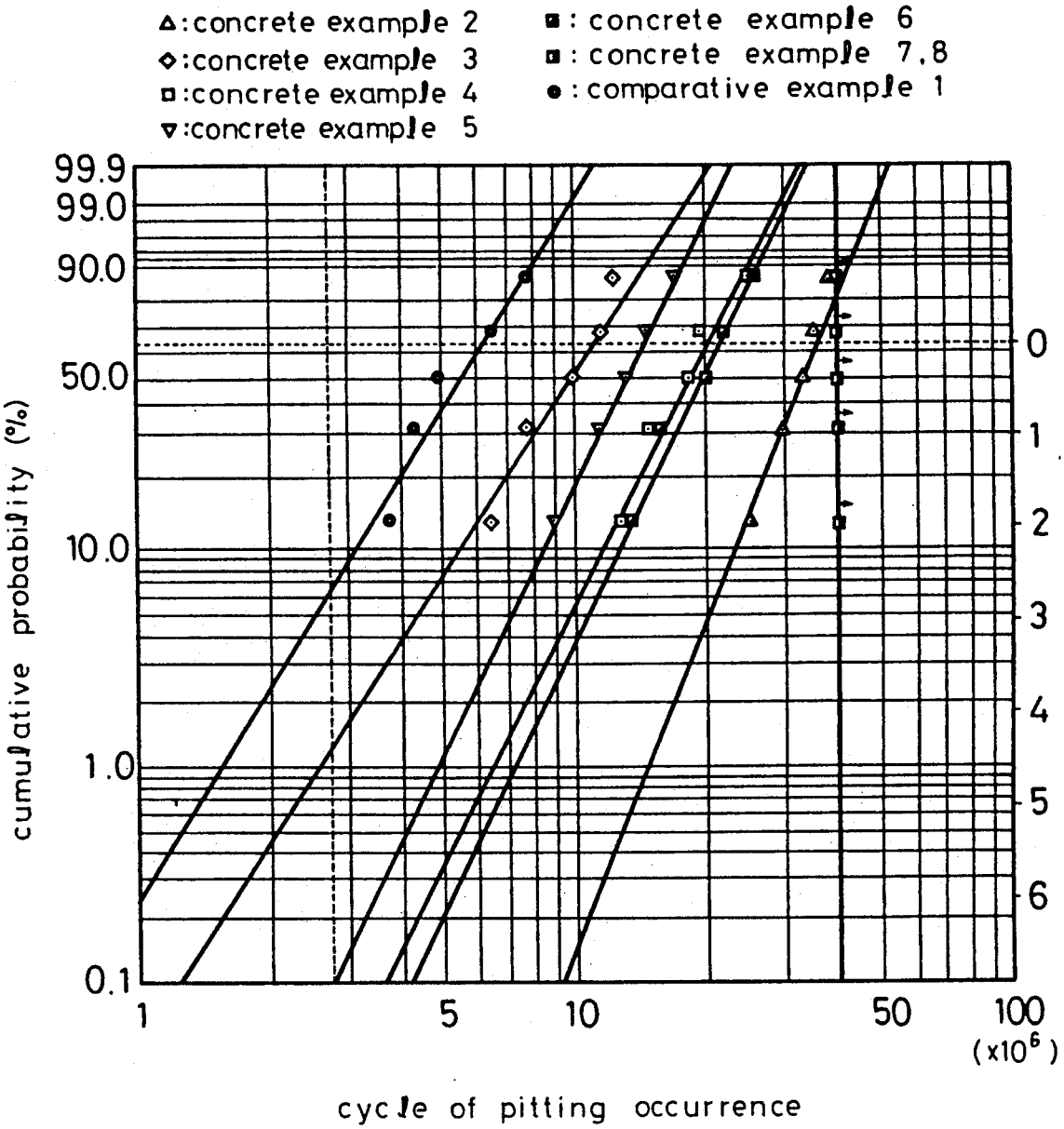
FIG. 8 shows results of pitting tests conducted for steel members obtained in examples 1 through 8 and comparative example 1.

FIG. 7 and FIG. 8 show Weibull-analyzed result of pitting test conducted for two cylinders. FIG. 7 illustrates test results of example 1 and comparative example 1 and 2. FIG. 8 illustrates test results of examples 2 through 8 and comparative example 1. Testing conditions are: nominal plane pressure; 365 kgf/mm$^2$, slip ratio; 30%, oil temperature; 50°±3° C.

As clearly shown in FIG. 7, the pitting life of example 1 was doubled compared with comparative example 1. Although treated by aging, the pitting life of comparative example 2 was not improved well compared with example 1. This is probably because, despite surface hardening by aging treatment, tempering after quench hardening resulted in a lower level of compressive residual stress, which led to decrease in effect of restricting pitting crack propagation.

As clearly shown in FIG. 8, pitting life is improved in examples 2 through 8 compared with comparative example 1. As for examples 7 and 8, pitting occurrence cycle was confirmed to be not less than $40\times10^6$ and no further measurement was conducted. Pitting life is more improved in example 2 than in example 1 (refer to FIG. 7). It shows that aging effect by nitrogen added in carbo-nitriding was efficient. The reason why pitting life of examples 3 through 8 are improved is due to aging effect in the step of coating treatment and surface conformability of the coating itself.

As described above, since the manufacturing method of the steel member of the present invention does not include tempering after the step of quench hardening, the amount of retained austenite does not decrease.

Consequently, retained austenite present in abundance in the steel material is hardened by shot peening, and this leads to creation of relatively high compressive residual stress in the steel material. Thus, propagation of fatigue cracks and pitting crack can be restrained, thereby effectively improving fatigue strength of the steel member obtained.

In addition to the improved fatigue strength due to shot peeing, there is a further advantage in the present invention. Severe treatment like shot peening may form microholes in the surface of the steel material. However, since aging treatment is conducted after shot peening, enterable atoms such as carbon and nitrogen enter into and are held in these microholes. As a result, increased hardness in the surface layer of the steel material prevents occurrence of pitting cracks, thereby improving pitting strength of the steel member.

It should be noted that when aging the steel member with lubricating coating treatment in the surface thereof, pitting strength will be further improved due to surface conformability of lubricating coating itself, in addition to the effect of aging treatment mentioned above.

What is claimed is:

1. A method of manufacturing a steel member, comprising the steps of:

(a) carburizing and quenching, or carbo-nitriding and quenching a steel material;

(b) shot-peening the quenched steel material; and (c) aging the shot-peened steel material, said method being conducted without any tempering step.

2. The method according to claim 1, wherein the hardening depth of said steel member quenched in step (a) is within the range of 0.2 to 1.3 mm.

3. The method according to claim 1, wherein shot-peening in step (b) is conducted at a shot-hardness within the range of $H_RC50$ to 65 and/or a shot-speed within the range of 60 to 150 m/sec.

4. The method according to claim 1, wherein said aging is conducted by holding the shot-peened steel material for not less than 10 minutes in the temperature range of 100° to 200° C.

5. The method according to claim 1, which further comprises forming a lubricating coating on the surface of the shot-peened steel material before said aging.

6. The method according to claim 1, wherein said steel material comprises from 0.1 to 0.4 wt % C, from 0.06 to 0.15 wt % Si, from 0.3 to 1.0 wt % Mn, from 0.9 to 1.2 wt % Cr, from 0.3 to 0.5 wt % Mo, and the remainder Fe.

* * * * *